US011791558B2

(12) United States Patent
Odes

(10) Patent No.: US 11,791,558 B2
(45) Date of Patent: Oct. 17, 2023

(54) SIMPLE ULTRA WIDE BAND VERY LOW PROFILE ANTENNA

(71) Applicant: GM GLOBAL TECHNOLOGY OPERATIONS LLC, Detroit, MI (US)

(72) Inventor: Uriel Zvi Odes, Givaat Shmuel (IL)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 87 days.

(21) Appl. No.: 17/409,543

(22) Filed: Aug. 23, 2021

(65) Prior Publication Data

US 2023/0055236 A1 Feb. 23, 2023

(51) Int. Cl.

| | |
|---|---|
| ***H01Q 9/40*** | (2006.01) |
| ***H01Q 9/42*** | (2006.01) |
| ***H01Q 1/48*** | (2006.01) |
| ***H01Q 1/38*** | (2006.01) |
| ***H01Q 5/25*** | (2015.01) |

(52) U.S. Cl.

CPC ..... *H01Q 9/40* (2013.01); *H01Q 1/38* (2013.01); *H01Q 1/48* (2013.01); *H01Q 5/25* (2015.01); *H01Q 9/42* (2013.01)

(58) Field of Classification Search

CPC .. H01Q 9/40; H01Q 5/25; H01Q 1/38; H01Q 1/48; H01Q 9/42; H01Q 1/27; H01Q 9/0407

See application file for complete search history.

(56) References Cited

U.S. PATENT DOCUMENTS 2,721,263 A * 10/1955 Spencer ..... H01Q 13/02 343/762
2,841,793 A * 7/1958 Young, Jr. ..... H01Q 15/06 343/909
3,170,158 A * 2/1965 Rotman ..... H01Q 25/008 343/753
5,926,150 A * 7/1999 McLean ..... G01R 29/0821 343/846
6,483,463 B2 11/2002 Kadambi et al.

(Continued)

FOREIGN PATENT DOCUMENTS

CN 101102009 A 1/2008
CN 204088560 U 1/2015

(Continued)

OTHER PUBLICATIONS

Machine translation of KR-101888399-B1 generated Jan. 11, 2023 (Year: 2023).*

(Continued)

*Primary Examiner* — Dimary S Lopez Cruz
*Assistant Examiner* — Jordan E. DeWitt

(57) ABSTRACT

An ultra wide band antenna includes a ground plane and an antenna body. The antenna body includes a planar portion arranged above and parallel to the ground plane. A first tapered portion extends in a perpendicular direction from a first edge of the planar portion towards the ground plane. A lower edge of the first tapered portion is spaced from the ground plane by a predetermined gap. A second tapered portion extends in a perpendicular direction from a second edge of the planar portion towards the ground plane and includes a first portion that is connected to the ground plane.

14 Claims, 4 Drawing Sheets

(56) References Cited

U.S. PATENT DOCUMENTS 6,590,541 B1 * 7/2003 Schultze ..... H01Q 9/40 343/866
6,903,687 B1 * 6/2005 Fink ..... H01Q 9/0407 333/126
6,950,068 B2 9/2005 Bordi et al.
7,019,698 B2 * 3/2006 Miyoshi ..... H01Q 1/40 343/702
8,159,403 B1 * 4/2012 Chen ..... H01Q 21/205 343/705
8,421,700 B2 * 4/2013 Sanford ..... H01Q 21/08 343/773
8,736,506 B1 * 5/2014 Brock ..... H01Q 9/40 343/786
9,331,392 B1 * 5/2016 Bermeo ..... H01Q 13/10
9,407,012 B2 * 8/2016 Shtrom ..... H01Q 9/26
9,673,536 B2 * 6/2017 Ng ..... H01Q 9/28
10,074,909 B2 * 9/2018 Su ..... H01Q 21/205
2003/0025637 A1 * 2/2003 Mendolia ..... H01Q 9/0421 343/702
2003/0038749 A1 2/2003 Chen
2004/0012530 A1 * 1/2004 Chen ..... H01Q 9/40 343/702
2005/0146471 A1 * 7/2005 Kwon ..... H01Q 1/38 343/702
2006/0164305 A1 * 7/2006 Chen ..... H01Q 5/50 343/795
2006/0176221 A1 * 8/2006 Chen ..... H01Q 9/40 343/702
2006/0227051 A1 10/2006 Yamamoto et al.
2007/0024511 A1 * 2/2007 Li ..... H01Q 9/0428 343/700 MS
2007/0229367 A1 10/2007 Fukui et al.
2008/0012785 A1 * 1/2008 Maxwell ..... H01Q 1/1221 343/891
2008/0122700 A1 * 5/2008 Mei ..... H01Q 1/2291 343/700 MS
2009/0027273 A1 * 1/2009 Lin ..... H01Q 19/005 343/700 MS
2009/0027294 A1 1/2009 Bourry et al.
2009/0128415 A1 * 5/2009 Song ..... H01Q 9/42 343/700 MS
2009/0284419 A1 * 11/2009 Kim ..... H01Q 9/40 343/700 MS
2010/0026593 A1 * 2/2010 Chang ..... H01Q 1/2266 343/702
2010/0103070 A1 * 4/2010 Coupez ..... H01Q 9/44 343/848
2010/0289705 A1 * 11/2010 Shtrom ..... H01Q 15/14 343/702
2010/0315296 A1 * 12/2010 Toor ..... H01Q 1/2258 343/702
2010/0315303 A1 * 12/2010 Kearney ..... H01Q 9/42 343/848
2012/0068892 A1 * 3/2012 Shtrom ..... H01Q 21/205 343/702
2012/0081252 A1 * 4/2012 Pan ..... H01Q 21/30 343/700 MS
2012/0229342 A1 * 9/2012 Maeda ..... H01Q 9/38 343/700 MS
2013/0038495 A1 * 2/2013 Benzel ..... H01Q 21/064 343/770
2014/0035698 A1 * 2/2014 Schadler ..... H01Q 21/0075 333/128
2014/0285382 A1 9/2014 Dobric
2016/0233590 A1 * 8/2016 Ng ..... H01Q 21/205
2017/0047660 A1 2/2017 Manry, Jr.
2017/0141480 A1 * 5/2017 Ng ..... H01Q 1/521
2018/0090834 A1 * 3/2018 Ng ..... H01Q 21/0006
2018/0219282 A1 * 8/2018 Hefele ..... H01Q 1/42
2018/0337461 A1 * 11/2018 Kildal ..... H01Q 9/26
2018/0358697 A1 12/2018 Zhou et al.
2019/0131699 A1 * 5/2019 Shamblin ..... H01Q 19/005
2019/0131700 A1 * 5/2019 Chao ..... H01Q 21/30
2019/0334242 A1 * 10/2019 Wilson ..... H01Q 9/0414
2020/0335857 A1 10/2020 Shoji et al.
2021/0174709 A1 * 6/2021 Xiang ..... H05K 1/028
2022/0407237 A1 * 12/2022 Bamford ..... H01Q 21/28

FOREIGN PATENT DOCUMENTS

CN 104701622 A 6/2015
CN 105529530 A * 4/2016 ..... H01Q 1/38
CN 109103592 A * 12/2018 ..... H01Q 1/38
CN 109687132 A * 4/2019
CN 111162382 A * 5/2020 ..... G01S 13/88
CN 210668675 U 6/2020
CN 112886196 A * 6/2021 ..... H01Q 1/246
CN 113471666 A * 10/2021
DE 202018103095 U1 * 1/2019
JP 6151251 B2 6/2017
KR 101888399 B1 * 8/2016 ..... H01Q 9/045
KR 101888399 B1 8/2018
WO WO-2016018547 A1 * 2/2016 ..... H01Q 1/42

OTHER PUBLICATIONS

U.S. Appl. No. 17/409,586, filed Aug. 23, 2021, Odes.
U.S. Appl. No. 17/409,627, filed Aug. 23, 2021, Odes.
U.S. Appl. No. 17/409,646, filed Aug. 23, 2021, Odes.

* cited by examiner

SIMPLE ULTRA WIDE BAND VERY LOW PROFILE ANTENNA

CROSS-REFERENCE TO RELATED APPLICATIONS

This application is related to U.S. patent application Ser. No. 17/409,586 filed on Aug. 23, 2021 and entitled "EXTREMELY LOW PROFILE ULTRA WIDE BAND ANTENNA;" U.S. patent application Ser. No. 17/409,627 filed on Aug. 23, 2021 and entitled "SPIRAL TAPERED LOW PROFILE ULTRA WIDE BAND ANTENNA;" and U.S. patent application Ser. No. 17/409,646 filed on Aug. 23, 2021 and entitled "SIMPLE ULTRA WIDE BAND VERY LOW PROFILE ANTENNA ARRANGED ABOVE SLOPED SURFACE." The entire disclosure of the applications referenced above is incorporated herein by reference.

INTRODUCTION

The information provided in this section is for the purpose of generally presenting the context of the disclosure. Work of the presently named inventors, to the extent it is described in this section, as well as aspects of the description that may not otherwise qualify as prior art at the time of filing, are neither expressly nor impliedly admitted as prior art against the present disclosure.

The present disclosure relates to antennas and more particularly to ultra wide band antennas.

Vehicles use telematics systems to support wireless telecommunications and information processing. Examples include cellular communications, global positioning system (GPS) navigation, integrated hands-free cell phones, wireless safety communication, vehicle to vehicle (V2V) communication, vehicle to infrastructure (V2I) communication, autonomous driving systems, etc.

The telematics systems transmit and receive data as the vehicle is driven on the road. To facilitate wireless connectivity, the vehicles include one or more antennas that are connected to transmitters and/or receivers of the telematics systems. Examples of antennas that are currently used include mast antennas and shark fin antennas. Various subsystems in the telematics systems transmit and receive on multiple different frequency bands. Therefore, ultra wide band (UWB) antennas are good candidates for cellular applications.

Manufacturers attempt to create cost-effective, fuel-efficient vehicles with attractive styling. Currently-used antenna designs are typically not desirable from a styling viewpoint. For example, the shark fin antenna may be arranged on the roof of the vehicle above a middle of the rear windshield or on the rear deck lid. As can be appreciated, placing the shark fin antenna in those locations detracts from the external design of the vehicle. These types of antennas typically have a height that is approximately ¼ of a wavelength corresponding to a lowest desired operating frequency. For example, an antenna designed to operate at a lowest frequency of 1.7 GHz has a height of about 44 mm high, which makes the antenna difficult to package.

SUMMARY

An ultra wide band antenna includes a ground plane and an antenna body. The antenna body includes a planar portion arranged above and parallel to the ground plane. A first tapered portion extends in a perpendicular direction from a first edge of the planar portion towards the ground plane. A lower edge of the first tapered portion is spaced from the ground plane by a predetermined gap. A second tapered portion extends in a perpendicular direction from a second edge of the planar portion towards the ground plane and includes a first portion that is connected to the ground plane.

In other features, a height of the first and second tapered portions relative to the ground plane is equal to approximately 1/10 of a wavelength corresponding to a desired operating frequency. The planar portion has a rectangular shape. The first tapered portion and the second tapered portion have a trapezoidal shape. A horizontal width of the first tapered portion and the second tapered portion increases monotonically increases as a distance between the ground plane and the planar portion decreases. An antenna feed is connected to a lower edge of the first tapered portion located adjacent to the ground plane. A width of the antenna body is equal to 0.5 to 5 times the height of the first tapered portion and the second tapered portion.

In other features, a length of the antenna body is equal to 0.5 to 5 times the height of the first tapered portion and the second tapered portion. Tapered sides of the first tapered portion and the second tapered portion form an angle in a range from 30 to 60 degrees relative to a line perpendicular to the ground plane. The planar portion includes arcuate portions that extend outwardly along opposite edges of the planar portion located between the first edge and the second edge of the planar portion. Lower edges of the first tapered portion and the second tapered portion are curved.

An ultra wide band antenna includes a first antenna body including a first planar portion and a first tapered portion extending in a perpendicular direction from a first edge of the first planar portion. A second tapered portion extends in a perpendicular direction from a second edge of the first planar portion. A second antenna body inverted relative to the first antenna body and includes a second planar portion arranged parallel to and spaced from the first planar portion. A third tapered portion extends in a perpendicular direction from a first edge of the second planar portion towards the first tapered portion and defining a predetermined gap between inner edges of the first tapered portion and the second tapered portion. A fourth tapered portion extends in a perpendicular direction from a second edge of the second planar portion towards and connecting to the third tapered portion.

In other features, a height of the first tapered portion, the second tapered portion, the third tapered portion and the fourth tapered portion is equal to approximately 1/10 of a wavelength corresponding to a desired operating frequency of the ultra wide band antenna. The first planar portion and the second planar portion have a rectangular shape. The first tapered portion, the second tapered portion, the third tapered portion and the fourth tapered portion have a trapezoidal shape.

In other features, an antenna feed is connected to lower edges of the first tapered portion and the third tapered portion. Widths of the first antenna body and the second antenna body are equal to 0.5 to 5 times the height of the first tapered portion. Lengths of the first antenna body and the second antenna body are equal to 0.5 to 5 times the height of the first tapered portion. Tapered sides of the first tapered portion and the second tapered portion form an angle in a range from 30 to 60 degrees relative to a line perpendicular to the first planar top portion and the second planar top portion, respectively.

In other features, the first antenna body includes one of curved portions and triangular portions extending outwardly along opposite edges of the first planar portion that are located between the first and second edges of the first planar portion. Lower edges of the first and second tapered portions are curved.

Further areas of applicability of the present disclosure will become apparent from the detailed description, the claims and the drawings. The detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

In the drawings, reference numbers may be reused to identify similar and/or identical elements.

DETAILED DESCRIPTION

An ultra wide band (UWB) antenna according to the present disclosure has a very low profile to allow the antenna to be incorporated into a variety of vehicle locations. For example, the low profile allows the UWB antenna to be less noticeable when used as a cellular antenna on a roof of a vehicle. Alternately, the UWB antenna can be concealed below a non-conducting cover in a cavity formed in a roof of the vehicle and above a grounded conducting plane (which can be the same as or different than the ground plane of the antenna).

The shape of the UWB antenna is relatively simple, which makes manufacturing of the UWB antenna both simple and low cost. In some examples, the UWB antenna includes a flat metal portion that is stamped, bent and attached to a ground plane to create a very low profile UWB antenna.

Figure 1:
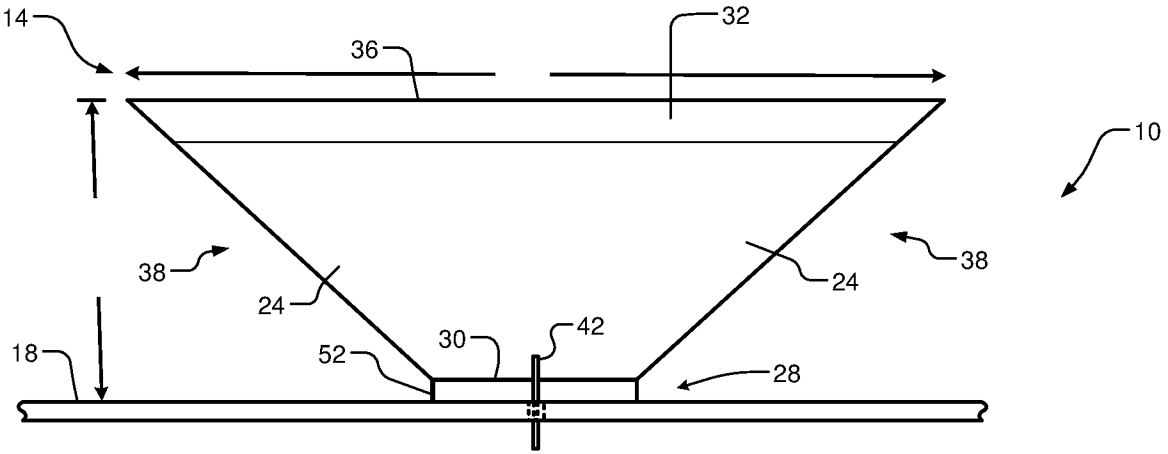
FIG. 1 is a side view of an example of an ultra wide band (UWB) antenna arranged above a ground plane according to the present disclosure.
Figure 2:
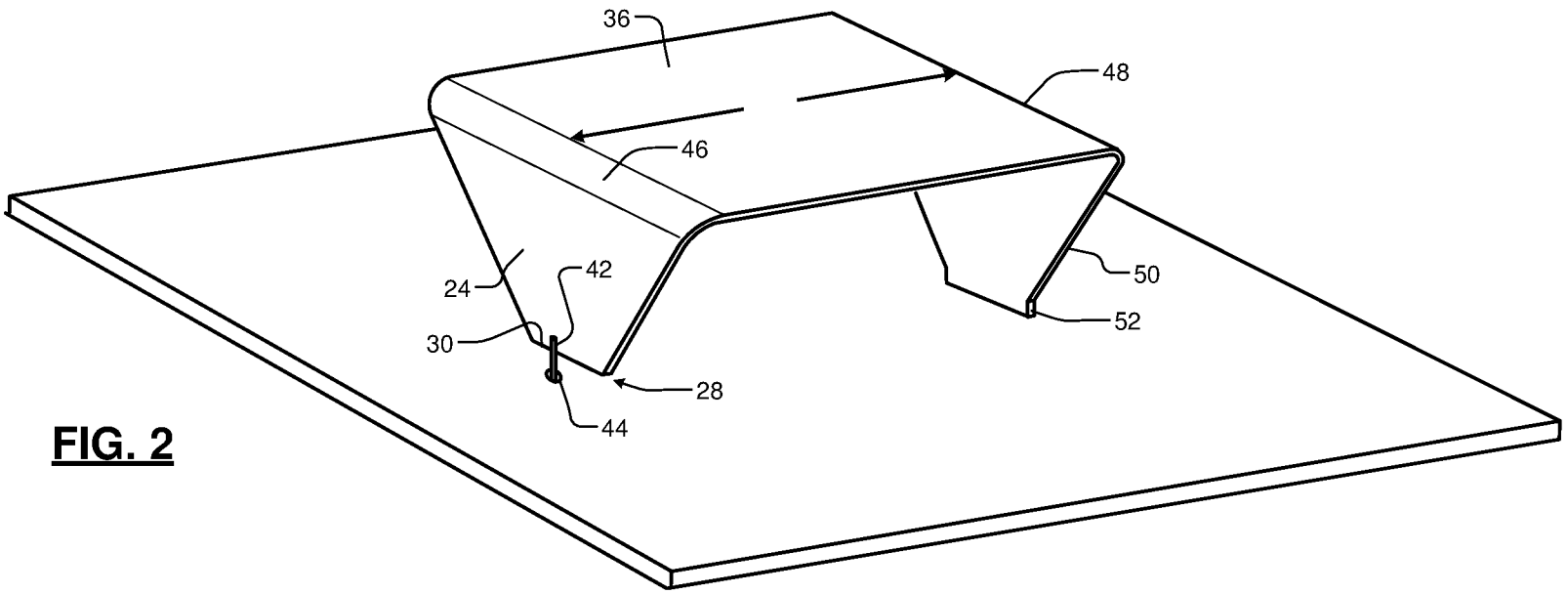
FIG. 2 is a perspective view of the UWB antenna of FIG. 1.

Referring now to FIGS. 1 and 2, an UWB antenna 10 is shown. The UWB antenna 10 includes a shaped antenna body 14 that is arranged above a ground plane 18. The antenna body 14 includes a first tapered portion 24 that is located above and extends perpendicular to the ground plane 18.

A gap 28 is defined between a lower edge 30 of the first tapered portion 24 and the ground plane 18. In some examples, a curved portion 32 is located between the first tapered portion 24 and a planar portion 36 extending in a plane parallel to the ground plane 18. Opposite side surfaces 38 of the first tapered portion 24 taper inwardly at an acute angle relative to a line perpendicular to the ground plane 18. In some examples, the opposite side surfaces 38 are straight. In other examples, the opposite side surfaces 38 may have some curvature. In some examples, the acute angle is in a range from 30° to 60° (e.g. 45°), although other angles may be used.

In some examples, an antenna feed 42 extends through a hole 44 in the ground plane 18 and is connected to the antenna body 14 near the lower edge 30 thereof. For example only, the antenna feed 42 can include an inner conductor of a coaxial cable (not shown) and a woven copper shield (not shown) of the coaxial cable can be connected to the ground plane 18. While a specific type of antenna feed is shown for illustration purposes, the antenna body 14 can be fed using other antenna feed arrangements. For example, the inner conductor of the antenna feed may be arranged parallel to the ground plane 18 and connected to the antenna feed location rather than passing through the ground plane 18.

The planar portion 36 is spaced above the ground plane 18 and extends generally parallel to the ground plane 18. The planar portion 36 extends between opposite edges 46 and 48 adjacent to the first tapered portion 24 and a second tapered portion 50. The second tapered portion 50 extends downwardly towards the ground plane 18 and includes a lower portion 52 that is connected to the ground plane 18. Opposite side surfaces 54 of the second tapered portion 50 taper inwardly in a manner similar to opposite side surfaces 38 of the first tapered portion 24 described above. In some examples, a horizontal width of the first tapered portion 24 and the second tapered portion 50 monotonically increases in a direction from the ground plane 18 toward the planar portion 36.

The antenna body 14 can be made entirely of conducting material such as metal. Alternately, one or more portions of the antenna body 14 can include a supporting surface that is made of a non-conducting material and inner or outer layer made of a conducting material.

In some examples, the planar portion 36 has a rectangular shape and the first and second tapered portions 24 and 50 have a trapezoidal shape. In some examples, the antenna body 14 is generally symmetric about a line passing through the planar portion halfway between the first and second tapered portions 24 and 50 (except for the lower portion 52 that is not symmetric), although the antenna may be somewhat asymmetric in this direction as well. In some examples, the antenna body 14 is generally symmetric about a line passing through the feed point and the width indicating line shown in FIG. 2, although the antenna may be somewhat asymmetric in this direction as well.

The first tapered portion 24 of the antenna body 14 acts as a monopole antenna, the planar portion 36 acts as a capacitor and the second tapered portion 50 acts as an inductor. A vertical height H of the antenna body 14 can be set to approximately 1/10 of a wavelength corresponding to a lowest desired operating frequency of the UWB antenna 10. As used herein, approximately 1/10 of a wavelength means 8% to 12% of the wavelength corresponding to the lowest desired operating frequency.

Most antenna designs require the height to be at least approximately 1/4 of the wavelength of the lowest operating frequency of the UWB antenna 10. In some examples, the width W and length L of the UWB antenna is in a range from 0.5 to 5 times the height H of the UWB antenna. In some examples, the ground plane 18 is wider than the L and W of the antenna body by first and second predetermined distances. The first and second predetermined distances can be the same (symmetric) or different (asymmetric).

As can be appreciated, the low height of the UWB antenna (approximately $1/10\lambda$) provides a significant advantage when attempting to locate the UWB antenna in unobtrusive locations to enhance the design of the vehicle. For example, the UWB antenna may be designed to operate at a lowest frequency of 1.7 GHz. The UWB antenna can be used for a first frequency band from 1.7 GHz to 2.7 GHz and a second frequency band from 3.3 GHz to 6 GHz, although other frequency bands can be used. Depending upon the configuration of the antenna, frequency bands from 1.7 GHz to 10 GHz can be supported.

For example, an UWB antenna according to the present disclosure can be designed with a height of about 17.5 mm for a desired lowest operating frequency of about 1.7 GHz. Other UWB antennas for the same operating frequency would need to have a height that is equal to approximately ¼λ, which is substantially greater (e.g. about 44 mm). The increased height of the conventional antenna would make it more difficult to locate the antenna in or on a vehicle without adversely impacting the design of the vehicle.

Figure 3:
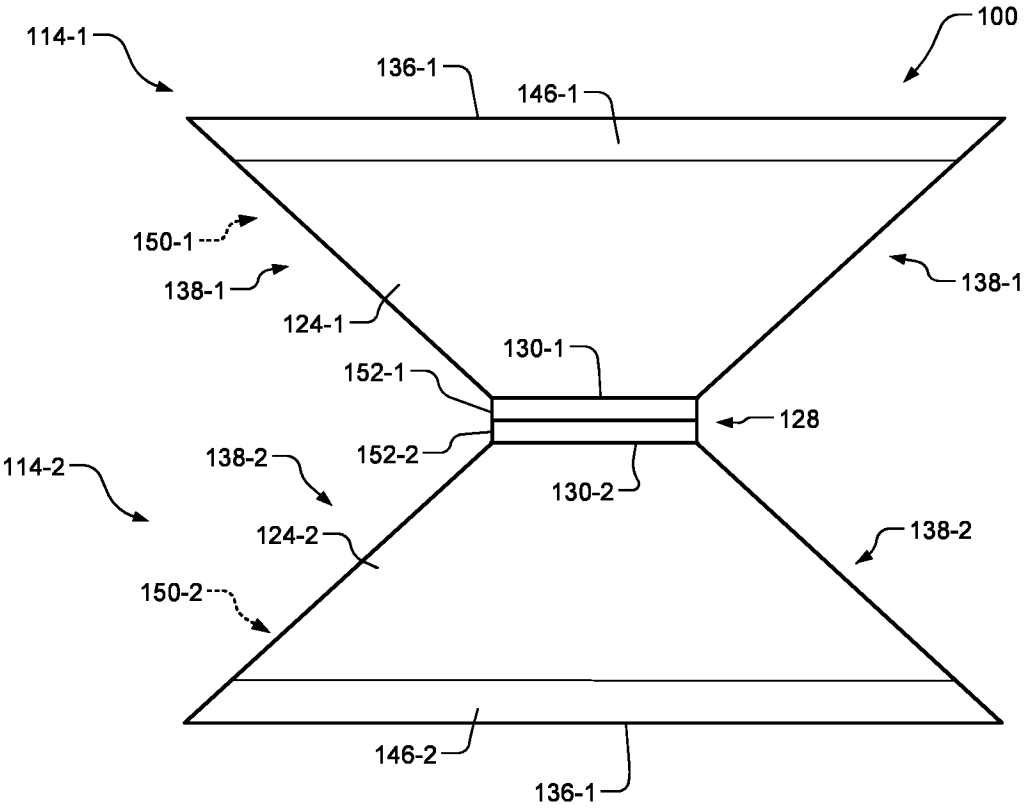
FIG. 3 is a side view of another example of an ultra wide band antenna with first and second antenna bodies arranged according to the present disclosure.
Figure 4:
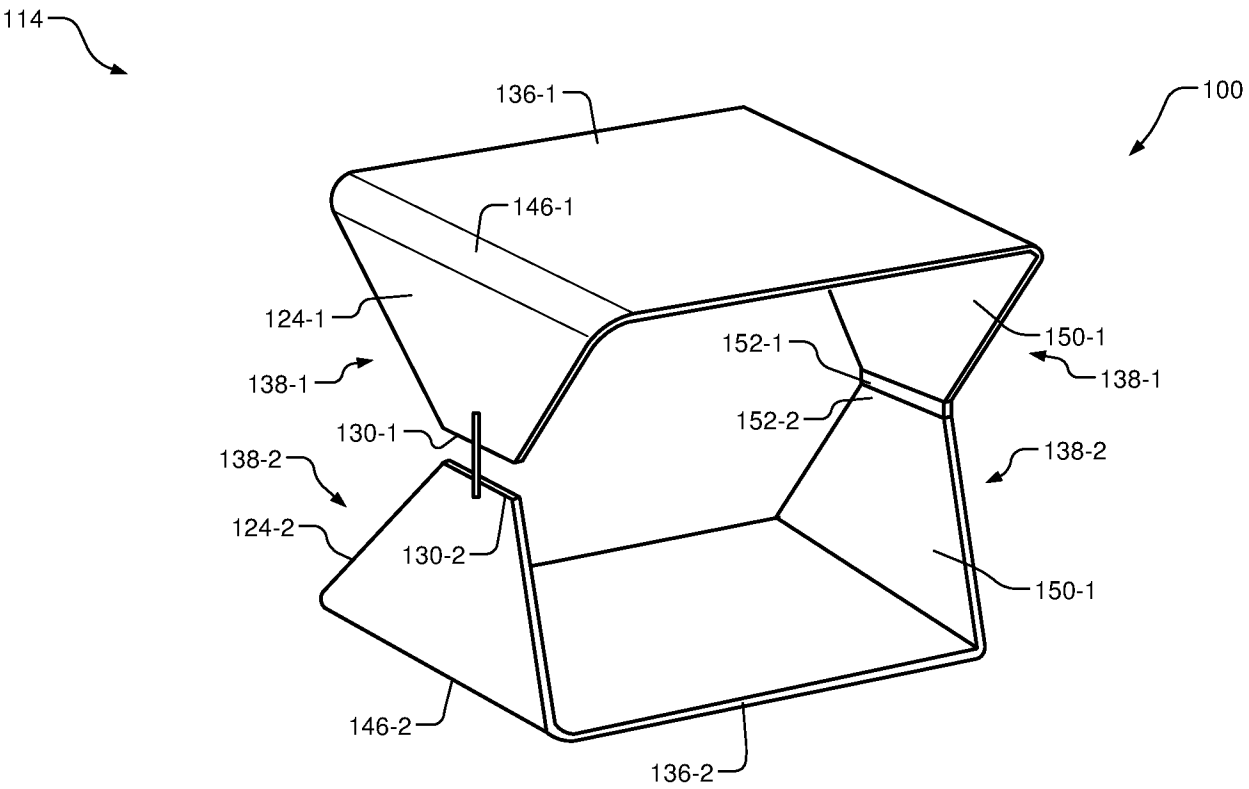
FIG. 4 is a perspective view of the UWB antenna of FIG. 3 according to the present disclosure.

In FIGS. 1 and 2, the UWB antenna 10 is similar to a monopole UWB antenna arranged above the ground plane 18. In this design, the ground plane 18 acts as a mirror. As with the duality of a monopole above a ground plane and a dipole in free space, a similar effect can be achieved by adding a second antenna body that is mirrored about a plane where the ground plane was previously located and connecting the second antenna to the antenna feed as is shown in FIGS. 3 and 4. The mirrored effect is similar to the mirroring of a monopole antenna above a ground plane to obtain a dipole antenna.

In FIGS. 3 and 4, another example of an UWB antenna 100 is shown. The UWB antenna 100 includes first and second antenna bodies 114-1 and 114-2. The second antenna body 114-2 is mirrored and arranged adjacent to the first antenna body 114-1. The first and second antenna bodies 114-1 and 114-2 include first tapered portions 124-1 and 124-2, respectively, as described above. A gap 128 is defined between edges 130-1 and 130-2 of the first tapered portions 124-1 and 124-2, respectively. Opposite side surfaces 138-1 and 138-2 of the first tapered portion 124-1 and the second tapered portion 124-2 taper inwardly towards one another as described above. In some examples, an antenna feed (not shown) is connected to the first and second antenna bodies 114-1 and 114-2 near lower edges 130-1 and 130-2 thereof.

The planar portions 136-1 and 136-2 extend generally parallel to one another. The second tapered portions 150-1 and 150-2 extend towards one another and lower portions or edges 152-1 and 152-2 thereof are connected together. Opposite side surfaces 154-1 and 154-2 of the second tapered portions 150-1 and 150-2 taper inwardly as described above.

Figure 5:
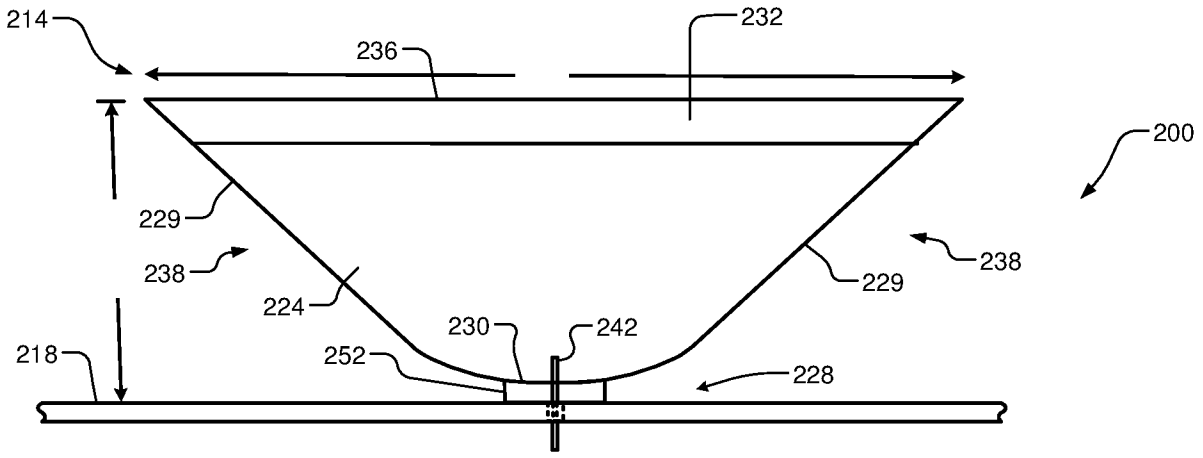
FIG. 5 is a side view of another example of an ultra wide band (UWB) antenna arranged above a ground plane according to the present disclosure.

Referring now to FIGS. 1 and 5, the length, width, height and shape of the UWB antennas described herein can be adjusted to achieve different design criteria such as frequency, bandwidth and/or radiation profile of the antenna.

Referring now to FIG. 5, an UWB antenna 200 is shown. The UWB antenna 200 includes an antenna body 214 arranged above the ground plane 218. In this example, a first tapered portion 224 of an antenna body includes a first straight portion 229 arranged at an acute angle relative to a planar portion 236, a second angled linear portion arranged at an acute angle relative to the planar portion and a curved portion 230 connecting the first and second straight portions 229 and 231, respectively. The curved portion 230 can correspond to an arcuate portion of a circle or ellipse. A gap 228 is defined between the curved portion 230 of the first tapered portion 224 and the ground plane 218.

The planar portion 236 extends from an edge near the first tapered portion 224 to an edge near a second tapered portion. The second tapered portion extends towards the ground plane 218 and includes a lower portion or edge 252 that is shorted to the ground plane 218. While a monopole design in shown in FIG. 5, a dipole arrangement similar to FIG. 3 can be used. For example, if the antenna in FIG. 5 is stretched horizontally, additional lower frequencies can be supported. Other dimensions of the UWB antenna can be varied to alter other properties of the UWB antenna.

Figure 7:
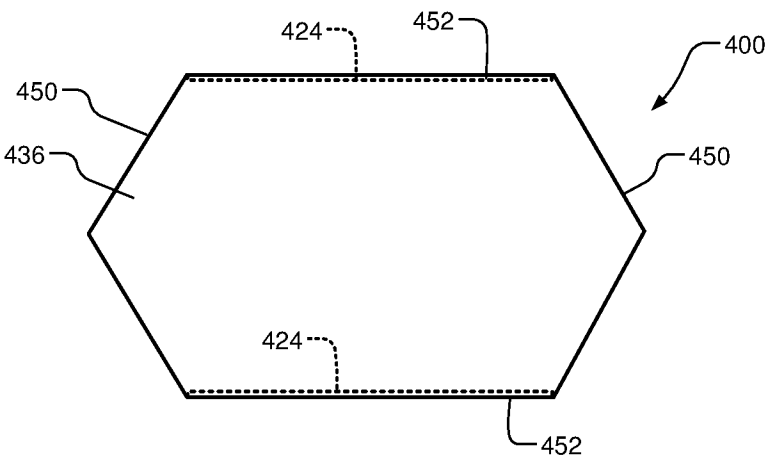
FIG. 7 is a plan view of another example of a planar portion of an antenna body according to the present disclosure.
Figure 6:
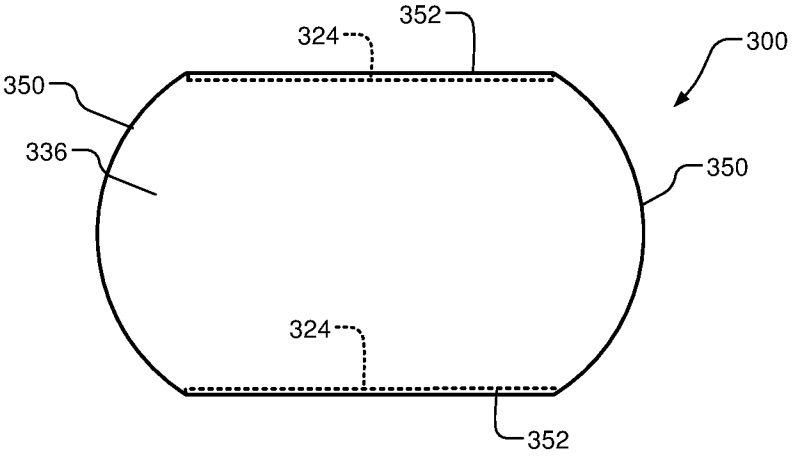
FIG. 6 is a plan view of an example of a planar portion of an antenna body according to the present disclosure.

Referring now to FIGS. 1, 6 and 7, a shape of a planar portion of the UWB antenna can be varied. In FIG. 1, the planar portion 36 of the antenna body 14 is rectangular. In FIG. 6, an UWB antenna 300 includes an antenna body with tapered side portions 324 located on opposite sides of a planar portion 336. In this example, edges 350 of the planar portion 336 (located at opposite sides of the planar portion 336 between edges 352 corresponding to the location of the tapered side portions 324) extend outwardly and have an arcuate profile.

In FIG. 7, an UWB antenna 400 includes an antenna body with tapered side portions 424 located on opposite sides of a planar portion 436. In this example, edges 450 of the planar portion 436 (located at opposite sides of the planar portion 436 between edges 452 corresponding to the location of the tapered side portions 424) extend outwardly and have a triangular profile. As can be appreciated, other profiles having different shapes can be used.

In some examples, the UWB antenna has an approximate bandwidth ratio of $F_{high}/F_{low}$=1:10, with $F_{high}$ being the highest frequency that the UWB antenna is matched to and $F_{low}$ being the lowest frequency the UWB antenna is matched to.

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. It should be understood that one or more steps within a method may be executed in different order (or concurrently) without altering the principles of the present disclosure. Further, although each of the embodiments is described above as having certain features, any one or more of those features described with respect to any embodiment of the disclosure can be implemented in and/or combined with features of any of the other embodiments, even if that combination is not explicitly described. In other words, the described embodiments are not mutually exclusive, and permutations of one or more embodiments with one another remain within the scope of this disclosure.

Spatial and functional relationships between elements (for example, between modules, circuit elements, semiconductor layers, etc.) are described using various terms, including "connected," "engaged," "coupled," "adjacent," "next to," "on top of," "above," "below," and "disposed." Unless explicitly described as being "direct," when a relationship between first and second elements is described in the above disclosure, that relationship can be a direct relationship where no other intervening elements are present between the first and second elements, but can also be an indirect relationship where one or more intervening elements are present (either spatially or functionally) between the first and second elements. As used herein, the phrase at least one of A, B, and C should be construed to mean a logical (A OR B OR C), using a non-exclusive logical OR, and should not be construed to mean "at least one of A, at least one of B, and at least one of C."

What is claimed is:

1. An ultra wide band antenna, comprising:

a ground plane including a hole;

an antenna body including:

a planar portion arranged above and parallel to the ground plane;

a first tapered portion extending in a perpendicular direction from a first edge of the planar portion towards the ground plane, wherein a lower edge of the first tapered portion is spaced from the ground plane by a predetermined gap; and a second tapered portion extending in a perpendicular direction from a second edge of the planar portion towards the ground plane and including a first portion that is connected to the ground plane; and an antenna feed extending through the hole in the ground plane and connected to a lower edge of the first tapered portion, wherein tapered sides of the first tapered portion and the second tapered portion form an angle in a range from 30 to 60 degrees relative to a line perpendicular to the ground plane, and wherein the planar portion includes arcuate portions that extend outwardly along opposite edges of the planar portion located between the first edge and the second edge of the planar portion.

2. The ultra wide band antenna of claim 1, wherein a height of the first tapered portion and the second tapered portion relative to the ground plane is equal to approximately 1/10 of a wavelength corresponding to a desired operating frequency.

3. The ultra wide band antenna of claim 1, wherein the planar portion has a rectangular shape.

4. The ultra wide band antenna of claim 1, wherein the first tapered portion and the second tapered portion have a trapezoidal shape and wherein a horizontal width of the first tapered portion and the second tapered portion monotonically increases as a distance between the ground plane and the planar portion decreases.

5. The ultra wide band antenna of claim 2, wherein a width of the antenna body is equal to 0.5 to 5 times the height of the first tapered portion and the second tapered portion.

6. The ultra wide band antenna of claim 2, wherein a length of the antenna body is equal to 0.5 to 5 times the height of the first tapered portion and the second tapered portion.

7. The ultra wide band antenna of claim 1, wherein lower edges of the first tapered portion and the second tapered portion are curved.

8. An ultra wide band antenna, comprising:

a first antenna body including:

a first planar portion;

a first tapered portion extending in a perpendicular direction from a first edge of the first planar portion; and a second tapered portion extending in a perpendicular direction from a second edge of the first planar portion; and a second antenna body inverted relative to the first antenna body and including:

a second planar portion arranged parallel to and spaced from the first planar portion;

a third tapered portion extending in a perpendicular direction from a first edge of the second planar portion towards the first tapered portion and defining a predetermined gap between inner edges of the first tapered portion and the third tapered portion; and a fourth tapered portion extending in a perpendicular direction from a second edge of the second planar portion towards and connecting to the second tapered portion; and an antenna feed connected to inner edges of the first tapered portion and the third tapered portion, wherein tapered sides of the first tapered portion and the second tapered portion form an angle in a range from 30 to 60 degrees relative to a line perpendicular to the first planar top portion and the second planar top portion, respectively, and wherein the first and second planar portions includes arcuate portions that extend outwardly along opposite edges of the first and second planar portions.

9. The ultra wide band antenna of claim 8, wherein a height of the first tapered portion, the second tapered portion, the third tapered portion and the fourth tapered portion is equal to approximately 1/10 of a wavelength corresponding to a desired operating frequency of the ultra wide band antenna.

10. The ultra wide band antenna of claim 8, wherein the first planar portion and the second planar portion have a rectangular shape.

11. The ultra wide band antenna of claim 8, wherein the first tapered portion, the second tapered portion, the third tapered portion and the fourth tapered portion have a trapezoidal shape.

12. The ultra wide band antenna of claim 9, wherein widths of the first antenna body and the second antenna body are equal to 0.5 to 5 times the height of the first tapered portion.

13. The ultra wide band antenna of claim 9, wherein lengths of the first antenna body and the second antenna body are equal to 0.5 to 5 times the height of the first tapered portion.

14. The ultra wide band antenna of claim 8, wherein inner edges of the first tapered portion and the second tapered portion are curved.

* * * * *